US005650238A

United States Patent [19]

Urakawa et al.

[11] Patent Number: 5,650,238

[45] Date of Patent: Jul. 22, 1997

[54] ZINC-ELECTROPLATED STEEL SHEET

[75] Inventors: Takayuki Urakawa; Hideharu Koga; Toru Imokawa; Toyofumi Watanabe, all of Kawasaki-ku, Japan

[73] Assignee: NKK Corporation, Tokyo, Japan

[21] Appl. No.: 501,394

[22] Filed: Jul. 12, 1995

[30] Foreign Application Priority Data

Aug. 1, 1994 [JP] Japan ..... 6-180126

[51] Int. Cl.[6] ..... B32B 15/18

[52] U.S. Cl. ..... 428/648; 428/658

[58] Field of Search ..... 428/648, 658, 428/659, 935, 926

[56] References Cited

U.S. PATENT DOCUMENTS

| | | | |
|---|---|---|---|
| 3,857,684 | 12/1974 | Kubu | 428/659 |
| 3,997,301 | 12/1976 | Yoshihara et al. | 428/648 |
| 4,190,504 | 2/1980 | Usui | 428/648 |
| 4,775,601 | 10/1988 | Leever et al. | 428/659 |
| 4,999,258 | 3/1991 | Wake et al. | 428/648 |
| 5,491,036 | 2/1996 | Carey et al. | 428/648 |

FOREIGN PATENT DOCUMENTS

| | | |
|---|---|---|
| 46-38888 | 11/1971 | Japan . |
| 57-14758 | 3/1982 | Japan . |
| 63-100193 | 5/1985 | Japan . |
| 1-36559 | 8/1989 | Japan . |

*Primary Examiner*—John Zimmerman

*Attorney, Agent, or Firm*—Frishauf, Holtz, Goodman, Langer, & Chick, P.C.

[57] ABSTRACT

A zinc-electroplated steel sheet comprises a steel sheet; a tin layer which is formed on the steel sheet, the tin layer having a deposition amount of 0.5 mg/m$^2$ to less than 10 mg/m$^2$; and a zinc-electroplating layer which is formed on the tin layer.

A method for producing a zinc-electroplated steel sheet comprising the steps of: pickling a steel sheet with a pickling solution so as to deposit a tin of an amount of 0.5 mg/m$^2$ to less than 10 mg/m$^2$ on the steel sheet; and zinc-electroplating the pickled steel sheet.

6 Claims, No Drawings

ZINC-ELECTROPLATED STEEL SHEET

BACKGROUND OF THE INVENTION

1. Field of the Invention

The present invention relates to a zinc-electroplated steel sheet which is used for a wide range of applications, such as household electric appliances, automobiles and construction materials, and a method thereof.

2. Description of the Related Arts

Various types of chromate-treated zinc-electroplating are increasingly demanded to be used for zinc-electroplated steel sheets without having a coating thereon for application of household electric appliances, and thus become an important application field. Since they are used without having a coating thereon, it is required that they should present an excellent surface appearance. The primary condition to satisfy the excellent surface appearance is to be free of surface defects, such as nonuniform plating or the like. A high degree of whiteness is also an important condition. Further, the surface is usually coated after it has been subjected to a phosphate treatment, in which case, if pale-colored coating or a thin film is applied to a phosphate-treated original sheet having a low degree of whiteness, there is a deterioration in its image clarity after it has been coated. It is thus required that the original sheet have a high degree of whiteness. The outer appearance of the sheet which has been subjected to various types of the above-described conversion treatments is certainly determined by the outer appearance obtained after the sheet has been subjected to plating. It is, therefore, necessary that before being subjected to the conversion treatments, the zinc-plated steel sheet be uniform and have a high degree of whiteness.

There are two types of nonuniform plating of the zinc-plated steel sheets. One type is caused by defects inherent in plating equipment, while the other type arises from the surface defects of the original sheets. The former type of nonuniform plating can be improved by eliminating the defects of the plating equipment. The latter type of nonuniform plating should naturally be eliminated by improving the surface defects of the original sheets. However, it is difficult to completely remove the surface defects of the original sheets from the industrial point of view, and no actual measures taken against such problems have yet been reported.

Various methods have been proposed to improve the outer appearance of zinc-plated steel sheets, such as: an old method of improving a degree of glossiness by adding polyacrylamide or polyvinyl alcohol to a plating bath, as disclosed in Japanese Examined Patent Publication No. 46-38888; a method of obtaining the outer appearance without exhibiting glare by performing an oxidation treatment subsequent to a plating pretreatment, as disclosed in Japanese Patent Laid-Open No. 63-100193; and a method of performing plating evenly in a white color with a high current density by adding non-ionic polyacrylamide to an acid zinc-plating bath, as disclosed in Japanese Examined Patent Publication No. 01-36559. Among these publications, only Japanese Examined Patent Publication No. 01-36559 refers to a degree of whiteness. In this publication, however, an improvement in the degree of whiteness is achieved only when a high current density having a range of from 100 to 450 A/dm$^2$ is applied, and if plating is performed with a current density lower than 100 A/dm$^2$, with which current density plating is usually carried out, no improvement in a degree of whiteness is observed. Thus, it is difficult to put such a method into practical use. As is understood from the foregoing description, no zinc-electroplated steel sheets which are free from surface defects, such as the nonuniform plating, and also have a high degree of whiteness have yet been proposed.

A technique of adding tin to an acid pickling bath is disclosed in Japanese Examined Patent Publication No. 57-14758. However, as disclosed in the specification, an object of the invention of this publication is to inhibit decreases in the corrosion resistance and heat resistance when zinc-electroplating using insoluble lead electrodes is employed in which a small amount of lead eluted from the lead anode is codeposited on the plating so as to be thermally treated. However, there is no description of the outer appearance of plating whatsoever in this publication. Additionally, in this method, a steel sheet is used as a cathode in an acid pickling solution so as to perform electrolytic pickling, with the result that a large amount of deposited tin as much as from 10 to 40 mg/m$^2$ is produced.

The present inventors made a study of the nonuniform plating caused by the surface defects of the original sheet, and found that the nonuniform plating arises from an extremely small amount of silica, alumina, titania and the like which are thickened on the surface of the original sheet. It was further understood that the zinc crystal deposited on the portion in which these oxides were thickened formed a finer-grained structure than that deposited on the portion free from these thickened oxides, which gives rise to a disparity in the outer appearance, thus making the nonuniform plating detectable. Although it is not clear what causes a finer-grained structure of the zinc crystal on the oxide-thickened portions, it is expected that the electrical resistance is increased in the oxide-thickened portions, which is considered to induce the reduction reaction of zinc ions and further to influence the generation of the crystalline nucleus, leading to the crystal growth. As has been discussed above, if the segregation of these oxides can be completely prevented, the nonuniform plating caused by the segregation will be avoided. However, only a very small amount of the oxides are segregated, and it is thus impossible to completely prevent them. The present inventors proceeded to make a study of a manufacturing method in which the nonuniform plating would be prevented even though a small amount of the oxides were segregated on the plating original sheet, and then, they found that an extremely small amount of tin was allowed to be deposited prior to plating, thereby preventing nonuniform plating. A mechanism in which nonuniform plating can be prevented is considered as follows.

Since tin is a much nobler metal than zinc and is also nobler than iron, it can be easily deposited. Accordingly, it can be readily deposited on both the surface containing the oxides and the surface not containing the oxides, which forms a uniform tin deposition layer, resulting in a uniform surface when zinc is deposited, thereby preventing the non-uniformity. Further, the present inventors proceeded to study an industrial and inexpensive application of a method of improving the nonuniform plating by means of the deposition of a small amount of tin. Then, they invented a nonuniform plating improvement method in which tin is added to an acid pickling solution, acid pickling being performed as a pretreatment of zinc plating. With this method, zinc-plated steel sheets can be manufactured without altering the currently-used zinc plating equipment and almost without increasing the manufacturing cost.

SUMMARY OF THE INVENTION

It is an object of the present invention to provide a zinc-electroplated steel sheet which is free from surface defects and has a high degree of whiteness and a method for producing the same.

To attain the above-mentioned object, the present invention provides a zinc-electroplated steel sheet comprising:

a steel sheet;

a tin layer which is formed on the steel sheet, the tin layer having a deposition amount of from 0.5 mg/m$^2$ to less than 10 mg/m$^2$; and a zinc-electroplating layer which is formed on the tin layer.

Furthermore, the present invention provides a method for producing a zinc-electroplated steel sheet comprising the steps of:

pickling a steel sheet with an acid pickling solution so as to deposit a tin of an amount of from 0.5 mg/m$^2$ to less than 10 mg/m$^2$ on the steel sheet; and zinc-electroplating the pickled steel sheet.

DESCRIPTION OF THE PREFERRED EMBODIMENT

In the present invention, a steel sheet is first passed through an acid pickling solution so as to perform a plating pretreatment. Tin sulfate, for example, in the amount of 0.1 to 20 g/liter, has been added to the acid pickling solution, whereby an amount of tin of 0.5 mg/m$^2$ or more but not more than 10 mg/m$^2$ is deposited on the surface of the plating original sheet. The tin is thus added to the acid pickling solution and then deposited on the original sheet, thereby making the surface of the original sheet uniform when the zinc crystal is deposited, and also making the zinc crystal uniform.

This further makes the depth of the grain boundary shallower, thereby decreasing an amount of light absorbed and increasing the intensity of the diffused and reflected light. Consequently, even though silica, alumina, titania and the like are segregated, nonuniform plating can be avoided, and also, the degree of whiteness can be improved. The degree of whiteness is preferably 85 or more.

An explanation will now be given of the reason that an amount of tin of 0.5 mg/m$^2$ or more but not more than 10 mg/m$^2$ is deposited on the surface of the plating original sheet. An amount of tin less than 0.5 mg/m$^2$ does not sufficiently exert the effect of preventing nonuniform plating nor does it exert the effect of improving the degree of whiteness. On the other hand, an amount of tin of 10 mg/m$^2$ or more causes the nonuniform outer appearance which may be caused by the deposition of tin. A more preferable range of the tin amount is 0.5 to 5 mg/m$^2$ for economical reason. A more preferable range is 1.5 to 8 mg/m$^2$ for improving the degree of whiteness. In order to obtain such a suitable amount of deposited tin, it is necessary to control the concentration of tin contained in the acid pickling solution. An amount of deposited tin is also influenced by the acid concentration, treatment time, treatment temperature and other conditions, and accordingly, the concentration of tin contained in the acid pickling solution should be determined in consideration of these conditions. For example, under typical acid pickling conditions (100 g of sulfuric acid/ performing a dip treatment for 1.5 seconds at a temperature of 30° C.), the amount of tin sulfate added to the acid pickling solution was 0.1–20 g/liter in order to obtain the amount of deposited tin of 0.5 mg/m$^2$ or more but not more than 10 mg/m$^2$. The amount of tin added to the acid pickling solution shall be measured relative to tin sulfate. The advantages obtained by adding tin result from tin ions (bivalent). Consideration is only given to tin compounds which are ionized to tin ions ( bivalent ) in the acid pickling solution, and it is possible to obtain similar advantages by adding other types of salts, for example, bivalent tin salts, such as tin chloride, tin diphosphate and the like.

A sulfuric acid solution is desirably used as the acid pickling solution. The concentration of the sulfuric acid solution is not particularly limited, and the advantages obtained by adding tin was observed at a concentration of 15–100 g/liter of the solution. Iron dissolved from the steel sheet was gradually increased in the acid pickling solution, the advantages obtained by adding tin were observed until the iron concentration became 20 g/liter.

Acid pickling can be performed by means of immersion as well as an electrolytic treatment. When the electrolytic treatment is employed, a current supplying method, what is called, the grid current supplying method, is often employed in typical electrolytic acid pickling used for performing a continuous zinc plating of strip. In this method, the electrode is switched between the anode and the cathode, and tin is deposited on the electrode which is switched to the cathode. When a considerable amount of tin is deposited, it is peeled from the electrode and is forced between the strip and the roll so as to produce a flaw, which further induces spark on the current supplying roll. Hence, in the grid current supply method, it is required that the polarities of the electrode be changed before tin deposited on the cathode is peeled so that tin deposited by anode current supply can be dissolved. It is thus necessary to change the polarities in a short period of time.

Then, electroplating is performed on the pre-treated steel plate in a sulfuric acid plating bath.

The chloride bath has a low plating voltage, which is, on one hand, advantageous in that high current density electrolysis can be readily performed and the like, but on the other hand, encounters a serious problem in that insoluble anodes cannot be used, thus increasing the cost of exchanging anodes. Therefore, the chloride bath is not suitable for a zinc plating bath for steel sheets.

The plating current density is not particularly limited. At a current density of from 30 to 150 A/dm$^2$, which is usually used for industrially manufacturing zinc-electroplated steel sheets, and, at even higher current density, for example, 200 A/dm$^2$, the advantages of preventing nonuniform plating and of improving the degree of whiteness can be obtained.

The applicable plating bath pH varies depending on the anode system. When the insoluble anode is used, the plating bath pH is desirably from 0.8 to 2.5. The plating efficiency undesirably becomes lower at a plating bath pH lower than 0.8. A plating bath pH in excess of 2.5 seriously decreases the chemical dissolving velocity of metal zinc, zinc oxide and the like, which are used for effecting the reaction of supplying zinc ions, thereby making it difficult to achieve ion supply. When the soluble anode is used, the plating bath ph is desirably from 3.0 to 5.0. A plating bath ph lower than 3.0 increases the velocity of the chemical dissolving reaction of the zinc anode, which further undesirably increases the concentration of the zinc ions contained in the plating bath. On the other hand, a plating bath ph in excess of 5.0 unsuitably causes the generation of a precipitate of zinc hydroxide.

The applicable plating temperature is not particularly limited.

The advantages of the present invention were observed at a temperature of from 40° to 60° C. which are typically applied to zinc-electroplating for steel sheets.

A coating weight of zinc is desirably from 5 to 100 g/m$^2$. In the case that the coating weight of zinc is less than 5 g/m$^2$, zinc does not sufficiently cover the surface of the steel sheet. In the case that the coating weight is more than 100 g/m$^2$, a crystal grain is coasened to deteriorate an outer appearance.

In the manner described above, according to the present invention, it is possible to obtain zinc plating which is improved in the degree of whiteness and thus presents the ideal outer appearance free from nonuniform plating and having a high degree of whiteness.

EXAMPLE

Example-1

A cold-rolled steel sheet in which silica, alumina, titania and the like are segregated on the original sheet and streak-like non-uniform plating would be caused by performing typical zinc plating was cleaned according to a conventional method. Then, plating was performed under the acid pickling conditions, the composition of a plating bath and plating conditions shown in Table 1 so that the coating weight would be 20 g/m$^2$. The appearance of non-uniformity of the obtained plating was visually evaluated, and the degree of whiteness was measured according to the method specified in JIS Z 8722 (condition d, the Hunter method) so as to be represented by the brightness index L. The results are shown in Table 2.

In each of the comparative examples A–E shown in Table 2, tin is not added. Streak-like non-uniform plating is detectable due to the segregation of oxides produced on the original sheet, and the degree of whiteness is less than 85. In each of the comparative examples F and G, the amount of tin added is as little as 0.05 g/liter. The streak-like nonuniform plating is less obvious in comparison to the comparative examples A–E, and the degree of whiteness is slightly improved. However, the level of improvement is not sufficient. In each of the comparative examples H and I, the amount of tin added is as large as 50 g/liter. The degree of whiteness is improved up to greater than 87, and the streak-like nonuniform plating is not detectable caused by the segregation of oxides produced on the original sheet. However, a large amount of nonuniform plating was produced on the entire plating surface. Although the cause of this nonuniform plating is not clear, it can be considered that the increased amount of deposited tin induces the nonuniform variations while being deposited.

In contrast, in each of the examples A–V, the amount of tin added is from 0.1 to 20 g/liter. The amount of deposited tin is thus limited in the range of 0.5 mg/m$^2$ or more but less than 10 mg/m$^2$ so that the appearance of nonuniformity can be prevented, and the degree of whiteness is 87 or more, thus presenting good outer appearance.

Example-2

By use of the same original sheet as that used in the example-1, plating was performed under the acid pickling conditions, the composition of the plating bath, and plating conditions shown in Table 3 so that the amount of resultant plating would be 20 g/m$^2$. The appearance of non-uniformity of the obtained plating was visually evaluated, and the degree of whiteness was measured according to the method specified in JIS Z 8722 (condition d, the Hunter method) so as to be represented by the brightness index L. The results are shown in Table 3.

Table 3 shows the effect achieved by the addition of tin when there is a variation in the composition of the plating bath. In comparison with the comparative examples in which tin was not added, the examples obtained by adding tin can avoid the appearance of non-uniformity and also be improved in the degree of whiteness by two points or over.

According to the present invention, a plating pretreatment is performed on an original sheet in an acid pickling solution, whereby a tin layer in which 0.5 mg/m$^2$ or more but less than 10 mg/m$^2$ of tin is deposited is formed on the steel sheet. Then, electroplating is performed in a sulfuric acid plating bath. With this method, it is possible to obtain a zinc-plated steel sheet which is free from the appearance of non-uniformity caused by surface defects and which exhibits the excellent degree of whiteness.

TABLE 1

ACID PICKLING CONDITIONS, COMPOSITION OF PLATING BATH, AND PLATING CONDITIONS OF FIRST EXAMPLE

| Acid pickling conditions (Immersion treatment) | Composition of plating bath | Plating conditions |
|---|---|---|
| Surfuric acid: 70 g/l<br>Tin sulfate: 0–30 g/l<br>Temperature: 25° C.<br>Treatment time<br>3–30 seconds | Zinc sulfate:<br>400 g/l<br>Aluminium sulfate:<br>60 g/l | pH: 1.5<br>Temperature: 50° C.<br>Flow velocity of plating liquid:<br>2 m/sec<br>Current density:<br>30–100 A/dm$^2$ |

TABLE 2

EFFECT OF PREVENTING APPEARANCE OF NONUNIFORMITY BY ADDING TIN AND OF IMPROVING DEGREE OF WHITENESS

| | Amount of tin added (g/l) | Acid pickling time (second) | Plating current density (A/dm$^2$) | Amount of tin deposited (mg/m$^2$) | Appearance of nonuniform plating | Degree of whiteness (L value) |
|---|---|---|---|---|---|---|
| Comparative example A | 0 | 5 | 30 | 0 | x | 84.7 |
| Comparative example B | 0 | 5 | 70 | 0 | x | 84.1 |
| Comparative example C | 0 | 5 | 100 | 0 | x | 84.8 |
| Comparative example D | 0 | 10 | 100 | 0 | x | 84.9 |
| Comparative | 0 | 30 | 100 | 0 | x | 84.5 |

TABLE 2-continued

EFFECT OF PREVENTING APPEARANCE OF NONUNIFORMITY BY ADDING TIN AND OF IMPROVING DEGREE OF WHITENESS

| | Amount of tin added (g/l) | Acid pickling time (second) | Plating current density (A/dm$^2$) | Amount of tin deposited (mg/m$^2$) | Appearance of nonuniform plating | Degree of whiteness (L value) |
|---|---|---|---|---|---|---|
| example E | | | | | | |
| Comparative example F | 0.05 | 5 | 100 | 0.2 | Δ | 85.6 |
| Comparative example G | 0.05 | 10 | 100 | 0.3 | Δ | 86.1 |
| Comparative example H | 30 | 10 | 100 | 11.0 | xx | 87.6 |
| Comparative example I | 30 | 20 | 100 | 19.3 | xx | 87.2 |
| Example A | 0.1 | 5 | 30 | 0.5 | o | 87.0 |
| Example B | 0.1 | 5 | 70 | 0.5 | o | 87.2 |
| Example C | 0.1 | 5 | 100 | 0.6 | o | 87.2 |
| Example D | 1 | 5 | 30 | 1.3 | o | 87.6 |
| Example E | 1 | 5 | 70 | 1.7 | o | 87.3 |
| Example F | 1 | 5 | 100 | 1.8 | o | 87.6 |
| Example G | 1 | 3 | 100 | 1.0 | o | 87.1 |
| Example H | 1 | 10 | 100 | 2.0 | o | 87.3 |
| Example I | 1 | 20 | 100 | 2.4 | o | 87.9 |
| Example J | 5 | 5 | 30 | 2.3 | o | 87.7 |
| Example K | 5 | 5 | 70 | 2.5 | o | 87.5 |
| Example L | 5 | 5 | 100 | 2.9 | o | 87.1 |
| Example M | 10 | 5 | 30 | 3.9 | o | 88.0 |
| Example N | 10 | 5 | 70 | 4.1 | o | 87.7 |
| Example O | 10 | 5 | 100 | 4.4 | o | 87.5 |
| Example P | 10 | 10 | 100 | 5.4 | o | 87.6 |
| Example Q | 10 | 20 | 100 | 7.8 | o | 87.3 |
| Example R | 20 | 3 | 100 | 5.8 | o | 87.6 |
| Example S | 20 | 5 | 100 | 7.1 | o | 88.0 |
| Example T | 20 | 10 | 100 | 8.0 | o | 87.4 |
| Example U | 20 | 20 | 100 | 9.6 | o | 87.3 |
| Example V | 20 | 30 | 100 | 9.9 | o | 87.1 |

Criteria for evaluating the appearance of nonuniformity
o: Uniform
Δ: Nonuniform (slight)
x: Appearance of streak-like non-uniformity caused by the segregation of oxides produced on the original sheet
xx: Appearance of non-uniformity on the overall surface which is not caused by the segregation of oxides produced on the original sheet

40

TABLE 3

EFFECT OF PREVENTING APPEARANCE OF NONUNIFORMITY BY ADDING TIN AND OF IMPROVING DEGREE OF WHITENESS

| | Composition of plating liquid (g/l) | | | | Amount of | Acid picling | Amount of tin | Appearance of | Degree of |
|---|---|---|---|---|---|---|---|---|---|
| | Zinc sulfate | Additive | pH | DK (A/dm$^2$) | tin added (g/l) | time (second) | deposited (mg/m$^2$) | nonuniform plating | whiteness (L value) |
| Comparative example A | 500 | — | 2 | 50 | 0 | 5 | 0 | x | 84.1 |
| Example A1 | 500 | — | 2 | 50 | 1 | 5 | 1.5 | o | 86.7 |
| Example A2 | 500 | — | 2 | 50 | 10 | 5 | 4.5 | o | 87.0 |
| Comparative example B | 500 | — | 2 | 150 | 0 | 5 | 0 | x | 84.0 |
| Example A1 | 500 | — | 2 | 150 | 1 | 5 | 1.7 | o | 86.4 |
| Example A2 | 500 | — | 2 | 150 | 10 | 5 | 6 | o | 86.7 |
| Comparative example C | 400 | Magnesium sulfate (50) | 1.5 | 100 | 0 | 5 | 0 | x | 84.0 |
| Comparative example C1 | 400 | Magnesium sulfate (50) | 1.5 | 100 | 1 | 5 | 1.4 | o | 86.1 |
| Comparative example C2 | 400 | Magnesium sulfate (50) | 1.5 | 100 | 10 | 5 | 5.3 | o | 87.2 |
| Comparative example D | 400 | Ammonium sulfate (40) | 2.5 | 70 | 0 | 5 | 0 | x | 83.9 |
| Comparative example D1 | 400 | Ammonium sulfate (40) | 2.5 | 70 | 1 | 5 | 1.4 | o | 86.9 |

TABLE 3-continued

EFFECT OF PREVENTING APPEARANCE OF NONUNIFORMITY BY ADDING TIN AND OF IMPROVING DEGREE OF WHITENESS

| | Composition of plating liquid (g/l) | | | | Amount of | Acid picling | Amount of tin | Appearance of | Degree of |
|---|---|---|---|---|---|---|---|---|---|
| | Zinc sulfate | Additive | pH | DK ($A/dm^2$) | tin added (g/l) | time (second) | deposited ($mg/m^2$) | nonuniform plating | whiteness (L value) |
| Comparative example D2 | 400 | Ammonium sulfate (40) | 2.5 | 70 | 10 | 5 | 5.1 | o | 87.1 |

Criteria for evaluating the appearance of nonuniformity
o: Uniform
Δ: Nonuniform (slight)
x: Appearance of streak-like non-uniformity caused by the segregation of oxides produced on the original sheet
Other Acid pickling conditions:
Composition of acid pickling liquid: sulfuric acid 50 g/l
Acid pickling temperature: 25° C.
Acid pickling method: immersion
Other plating conditions:
Temperature: 50° C.
Flow velocity of plating liquid: 2 m/second

What is claimed is:

1. A zinc-electroplated steel sheet comprising:

a steel sheet;

a tin layer which is formed on the steel sheet, the tin layer having a deposition amount of from 0.5 $mg/m^2$ to 5 $mg/m^2$; and a zinc-electroplating layer which is formed on the tin layer.

2. The zinc-electroplated steel sheet of claim 1, wherein the zinc-electroplating layer has a coating weight of 5 $g/m^2$ to 100 $g/m^2$.

3. The zinc-electroplated steel sheet of claim 1, wherein the zinc-electroplated steel sheet has a whiteness of at least 85, the whiteness being specified in JIS Z 8722.

4. A zinc-electroplated steel sheet comprising:

a steel sheet;

a tin layer which is formed on the steel sheet, the tin layer having a deposition amount of from 0.5 to 8 $mg/m^2$; and a zinc-electroplating layer which is formed on the tin layer.

5. The zinc-electroplated steel sheet of claim 4, wherein the tin layer has a deposition amount of from 0.5 to 7.1 $mg/m^2$.

6. The zinc-electroplated steel sheet of claim 4, wherein the tin layer has a deposition amount of 1.5 $mg/m^2$ to 8 $mg/m^2$.

* * * * *